US006347950B1

(12) United States Patent
Yokoyama et al.

(10) Patent No.: US 6,347,950 B1
(45) Date of Patent: Feb. 19, 2002

(54) FLOATING CONNECTOR

(75) Inventors: Katsuharu Yokoyama, Kobe; Kenji Nakata, Nishinomiya; Kenji Sugimori; Iwao Ishibashi, both of Tokyo, all of (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/818,032

(22) Filed: Mar. 26, 2001

(30) Foreign Application Priority Data

Sep. 14, 2000 (JP) ..... 2000-279269

(51) Int. Cl.[7] ..... H01R 13/64
(52) U.S. Cl. ..... 439/248; 439/62
(58) Field of Search ..... 439/247, 248, 439/62, 629, 630, 636, 637, 701

(56) References Cited

U.S. PATENT DOCUMENTS 6,159,030 A * 12/2000 Gawron et al. ..... 439/247
6,174,185 B1 * 1/2001 Cecil, Jr. ..... 439/248
6,217,363 B1 * 4/2001 Takata ..... 439/342
6,234,817 B1 * 5/2001 Hwang ..... 439/247

* cited by examiner

*Primary Examiner*—Khiem Nguyen
(74) *Attorney, Agent, or Firm*—Morrison Law Firm

(57) ABSTRACT

The present invention provides a floating connector, used for electrical connection between electrical components and a circuit board. Multiple embodiments include a plurality of elastic contacts retained between the circuit board and an insulated housing movable laterally and orthogonally in a fixed range to accommodate misalignment. The contacts are in sliding contact with the circuit board to ensure a reliable connection without solder. The embodiments employ guiding slits to maintain electrical separation between the contacts during adjustment. Each embodiment accommodates movement in multiple directions, requires no solder, and provides for secure flexible electrical connection between an electronic component and the circuit board.

16 Claims, 9 Drawing Sheets

PRIOR ART

FLOATING CONNECTOR

BACKGROUND OF THE INVENTION

1. Field of the Invention

The present invention relates to a floating connector that enables an electrical connection between electronic components even when the components are misaligned.

2. Description of the Invention

Electronic equipment, such as a car stereo, is typically assembled from a plurality of units. The units may include a CD unit, a MD unit, and a tuner unit depending on the user's tastes. The selected units are arranged in a chassis in multiple stages. Connectors electrically connect each unit to the required input equipment. The input equipment may be multiple switches allowing user operation through a panel.

Referring now to FIG. 13, an equipment chassis 1 includes units 2, 3, and 4, such as a CD unit, a MD unit, and a tuner unit. Units 2, 3, and 4 are arranged in three vertical stages and have different functions. Units 2, 3, and 4 internally include respective sub-substrates 2*a*, 3*a*, 4*a*. Sub-substrates 2*a*, 3*a*, and 3*b* mount manufacturer selected electronics (not shown) and have corresponding conductive patterns 2*b*, 3*b*, 4*b*. Conductive patterns 2*b*, 3*b*, and 4*b*, are printed on externally projecting end surfaces of each corresponding unit 2, 3, and 4. Conductive patterns 2*b* 3*b*, and 4*b* constitute external terminals electrically connected to corresponding printed circuit board connectors 100, 110, 120.

Printed circuit board connectors 100, 110, 120 include corresponding insulated housings 102, 112, 122. Insulated housings 102, 112, 122 include corresponding connection recess 102*a*, 112*a*, 122*a* shaped to receive corresponding sub-substrates 2*a*, 3*a*, 4*a*. Each connection recess 102*a*, 112*a*, 122*a*, includes a corresponding contact 101, 111, 121. Terminal portions 101*a*, 111*a*, 121*a*, are on a first side of each respective contact 101, 111, 121, and correspond to respective connection recess 102*a*, 112*a*, 122*a*. Lead-out portions 101*b*, 111*b*, and 121*b*, are on a second side of each contact 101, 111, 121.

Leg portions (not shown) of insulated housings 102, 112, and 122 penetrate through printed circuit board 130 and locate insulated housings 102, 112, 122, opposite to sub-substrates 2*a*, 3*a*, 4*a* of units 2, 3, and 4. Printed circuit board connectors 100, 110, 120 thus connect to printed circuit board 130 to allow sub-substrates 2*a*, 3*a*, 4*a* to insert into connection recesses 102*a*, 112*a*, and 122*a*.

Lead-out portions 101*b*, 111*b*, 121*b* are soldered to a lead portion (not shown) of printed circuit board 130. During assembly, sub-substrates 2*a*, 3*a*, 4*a* insert into connection recess 102*a*, 112*a*, 122*a* and terminal portions 101*a*, 111*a*, 121*a* contact conductive patterns 2*b*, 3*b*, 4*b* for electric connection.

In this structure, printed circuit board 130 and the equipment chassis 1 are assembled together and units 2, 3, 4 connect to the corresponding printed circuit board connectors 100, 110, 120.

In this structure when an assembly error occurs and the insertion angle(pitch) is not optimized, sub-substrates 2*a*, 3*a*, 4*a* of units 2, 3, 4 cannot simultaneously insert into printed circuit board connectors 100, 110, 120. If sub-substrates 2*a*, 3*a*, 4*a*, are forcibly inserted, equipment damage may result. Accordingly, a floating connector is frequently used which allows the components to absorb the attachment error.

Additionally referring now to FIGS. 14 and 15, showing a conventional floating connector described in Japanese Utility Model Publication No. 5-15747.

A floating connector 150 includes a front housing 160 and a rear housing 170. Front housing 160 includes a joining projection 161. Rear housing 170 includes a horizontal long joining hole 171. During assembly, joining projection 161 inserts into joining hole 171 to fix front housing 160 to rear housing 170. Joining hole 171 has a shape that retains joining projection 161 while allowing adjustment in a linear direction, as will be explained.

Rear housing 170 is positioned and fixed to a printed circuit board 190 by leg portions 173. Leg portions 173 are at opposite ends of rear housing 170. Leg portions 173 extend through printed circuit board 190. In an assembled state, front housing 160 can be moved in a linear direction, as shown by an arrow A, relative to rear housing 170.

It should be understood that printed circuit board 190 corresponds to the printed circuit board 130 for purposes of this disclosure.

A contact 180 includes a horizontal terminal portion 181, a vertical leadout portion 182, and a flexing portion 183. It should be understood that multiple contacts 180 may be employed with this assembly. Flexing portion 183 is between horizontal terminal portion 181 and vertical lead-out portion 182.

Lead-out portion 182 extends through a slits 172 in a rear portion of rear housing 170 to penetrate printed circuit board 190. Lead-out portions 182 connect to printed circuit board 190 by soldering to printed circuit board 190.

Terminal portion 181 penetrates through a contact through-hole 162 formed in front housing 160 and contacts a contact 220. Contacts 220 constitute external terminals of connectors 210 and are mounted on a printed circuit board 200. Thus, contact 180 achieves electrical connection with circuit board 200.

During assembly, when front housing 160 moves along the direction shown by the arrow A, flexing portions 183 of contacts 180 flex to maintain electrical connection between printed circuit boards 190 and 200. Thus, despite an error in assembly, front housing 160 moves to absorb the error, and enables printed circuit boards 190 and 200 to remain electrically connected.

Floating connector 150, however, has several functional and reliability problems:

First, since the movement of front housing 160 is only in one single direction, the single lateral direction shown by arrow A, error in another nonlateral single direction cannot be accommodated.

Second, since contacts 180 are soldered to printed circuit board 190, a soldering step is required, thereby increasing the number of connection steps and manufacturing costs.

Third, soldering and soldering byproducts may adversely affect the environment.

Fourth, since front housing 160 can move in only one direction and contacts 180 are fixed by soldering, when an external force such an impact or vibration causes front housing 160 to move cracks may occur in the solder and cause a faulty electrical connection.

The present invention has been provided in view of these conventional problems, and it is an object thereof to provide a floating connector that can be moved in multiple directions to accommodate a wide range of attachment errors and that requires no soldered portion while making the connection more reliable.

OBJECT AND SUMMARY OF THE INVENTION

It is an object of the present invention to provide a floating connector that accommodates movement and maintains an electrical connection between an electrical connector and an equipment chassis.

It is another object of the present invention to provide a floating connector that allows elastic contact with at least one of a plurality of land patterns on a printed circuit board.

It is another object of the present invention to provide a floating connector having a cover that surrounds and sandwiches an insulated housing between the cover and a printed board in a substantially locked but transversely and orthogonally adjustable state.

It is another object of the present invention to provide lead-out portions of contacts that are in elastic slidable contact with a printed circuit board.

It is another object of the present invention to provide an embodiment that allows slidable, two-dimensional adjustment along a surface of a printed circuit board.

It is another object of the present invention to provide an embodiment that allows slidable, three-dimensional adjustment orthogonal to a surface of a printed circuit board, thus allowing an insulated housing to move in directions both orthogonal and lateral to a printed circuit board.

It is another object of the present invention to provide a floating connector that minimizes soldering steps and simplifies assembly and construction while increasing reliability.

It is another object of the present invention to provide an embodiment of a floating connector having a cover made of metal or other material to increase the strength of the cover.

It is another object of the present invention to provide an embodiment of a floating connector having a metal cover that minimizes static electricity damage, shields minor electromagnetic waves, and connects to external grounding connectors.

It is another object of the present invention to provide an embodiment of a floating connector allowing well-balanced elastic connection between a plurality of land patterns and an external terminal thus minimizing inclination under a reaction force from a biased direction.

It is another object of the present invention to provide an embodiment of a floating connector where contacts project from opposite sides of a cover and cross one another.

It is another object of the present invention to provide embodiments allowing single or multiple slits and support plates adaptable to allow increased elastic motion of contacts and ensure long live and adaptability to a variety of customer needs.

Briefly stated, the present invention provides a floating connector, used for electrical connection between electrical components and a circuit board. Multiple embodiments include a plurality of elastic contacts retained between the circuit board and an insulated housing movable laterally and orthogonally in a fixed range to accommodate misalignment. The contacts are in sliding contact with the circuit board to ensure a reliable connection without solder. The embodiments employ guiding slits to maintain electrical separation between the contacts during adjustment. Each embodiment accommodates movement in multiple directions, requires no solder, and provides for secure flexible electrical connection between an electronic component and the circuit board.

According to an embodiment of the invention, there is provided a floating connector for use with a circuit board having a plurality of contact pads thereon, comprising: a support plate, a plurality of resilient contacts on a surface of the support plate which faces the circuit board, at least some of the resilient contacts being alienable with ones of the contact pads, a connection portion rising orthogonal to the support plate, the connection portion including means for positioning terminal portions connected to the resilient contacts, the means for positioning being effective for positioning the terminal portions accessible to an external plug, a cover fittable over the connection portion, an opening in the cover, the opening having an internal dimension larger than an external dimension of the connection portion, whereby a gap remains between the cover and the connection portion, the gap permitting the connection portion to adjust transversely to accommodate misalignment of the external plug, and means for latching the cover into frictional contact with the support plate whereby the resilient contacts are urged into contact with the contact pads without solder.

According to another embodiment of the invention, there is provided a floating connector, wherein: the means for positioning permitting the connection portion to adjust orthogonally to the circuit board to accommodate misalignment of the external plug.

According to another embodiment of the invention, there is provided a floating connector, further comprising: a presser portion in the cover, and the presser portion in frictional contact with the support plate thereby permitting the support plate to move transversely to accommodate misalignment of the external plug.

According to another embodiment of the invention, there is provided a floating connector, further comprising: an insert hole, the insert hole extends from a top side to a bottom side of the connection portion, a tapered guide surface on the top side of the insert hole, and the tapered guide surface permitting easy insertion of the external plug.

According to another embodiment of the invention, there is provided a floating connector, further comprising: a plurality of locking grooves on a first and second inner wall surface of the insert hole, the locking grooves being effective to electrically separate the terminal portions, and the locking grooves being effective to lock the terminal portions in the connection portion whereby the terminal portions are accessible to the external plug.

According to another embodiment of the invention, there is provided a floating connector, further comprising a plurality of slits on the support plate, the slits in at least a first row, the slits extending from the bottom side to a top side of the at least first support plate, each the slit being effective to receive and guide each the contact during adjustment, the slits being effective to electrically separate the contacts during adjustment.

According to another embodiment of the invention, there is provided a floating connector, further comprising: at least the first and a second support plate, the connection portion rising orthogonal to the second support plate, the second support plate opposite the first support plate, the slits in at least the first row on the second support plate, a first section of the terminal portions on the first inner wall surface, a second section of the terminal portions in the second inner wall surface, the first section connected to the resilient contacts on the first support plate, and the second section connected to the resilient contacts on the second support plate.

According to another embodiment of the invention, there is provided a floating connector, further comprising: the slits in the first and a second row, the first and second rows on each the first and second support plate, the second rows being further from the connecting portion than the first rows, the resilient contacts having one of at least a first and a second length, the second length greater than the first length, the slits in the first rows operably receiving the resilient contacts having the first lengths, the slits in the second rows operably receiving the resilient contacts having the second lengths, and the slits in the first rows alternating with the slits in the second rows to operably insulate and guide the contacts and permit elastic slidable electrical connection with the external circuit board without solder.

According to another embodiment of the invention, there is provided a floating connector, wherein: the cover is constructed from at least a first material, the first material being a metal, and the metal being effective to strengthen the cover whereby cover failure is minimized.

According to another embodiment of the invention, there is provided a floating connector, wherein: the cover is electrically grounded to the circuit board through an external ground pattern, whereby the cover is effective to shield the connection portion and the resilient contacts from electromagnetic waves and static disruption.

According to another embodiment of the invention, there is provided a floating connector, further comprising: at least the first and a second support plate, the connection portion rising orthogonal to the second support plate, the second support plate opposite the first support plate, the slits in at least the first row on the second support plate, a first section of the terminal portions on the first inner wall surface, a second section of the terminal portions in the second inner wall surface, the first section connected to the resilient contacts on the second support plate, the second section connected to the resilient contacts on the first support plate, and the resilient contacts operably extending across the insert hole and being operably effective to increase elastic deformation of the resilient contacts without solder.

According to another embodiment of the invention, there is provided a floating connector, further comprising: the slits in the first and a second row, the first and second rows on each the first and second support plate, the second rows being further from the connecting portion than the first rows, the resilient contacts having one of at least a first and a second length, the second length greater than the first length, the slits in the first rows operably receiving the resilient contacts having the first lengths, the slits in the second rows operably receiving the resilient contacts having the second lengths, and the slits in the first rows alternating with the slits in the second rows to operably insulate and guide the contacts and permit elastic slidable electrical connection with the external circuit board without solder.

According to another embodiment of the invention, there is provided a floating connector, wherein: the cover is constructed from at least a first material, the first material being a metal, and the metal being effective to strengthen the cover whereby cover failure is minimized.

According to another embodiment of the invention, there is provided a floating connector, wherein: the cover is electrically grounded to the circuit board through an external ground pattern, whereby the cover is effective to shield the connection portion and the resilient contacts from electromagnetic waves and static disruption.

According to another embodiment of the invention, there is provided a floating connector, further comprising: a plurality of vertical recessed slits, the recessed slits on at least one side of a first and second side of the connecting portion, the recessed slits operably extending from the at least one side to each corresponding the slit, the recessed slits opposite the locking grooves on at least one the first and second inner wall, a buffer portion on each the resilient contact, the buffer portions operable within the recessed slits, the buffer portions being effective to increase a spring span of each the resilient contact whereby elastic fatigue is reduced, and the vertical recessed slits being effective to electrically insulate each the buffer portion and the resilient contact during the adjustment along the circuit board without solder.

According to another embodiment of the invention, there is provided a floating connector, further comprising: at least the first and a second support plate, the connection portion rising orthogonal to the second support plate, the second support plate opposite the first support plate, the slits in the first row on the second support plate, the locking grooves on the first and the second inner wall surfaces, the terminal portions on the first inner wall surface extending under the second support plate, the terminal portions on the second inner wall surface extending under the first support plate, the resilient contacts flexibly extending across the insert hole, and the buffer portions flexibly extending across the insert hole and being effective to increase elastic deformation of the contacts whereby elastic fatigue of the resilient contacts is reduced.

The above, and other objects, features and advantages of the present invention will become apparent form the following description read in conjunction with the accompanying drawings, in which like reference numerals designate the same elements.

DETAILED DESCRIPTION OF THE INVENTION

Figure 1:
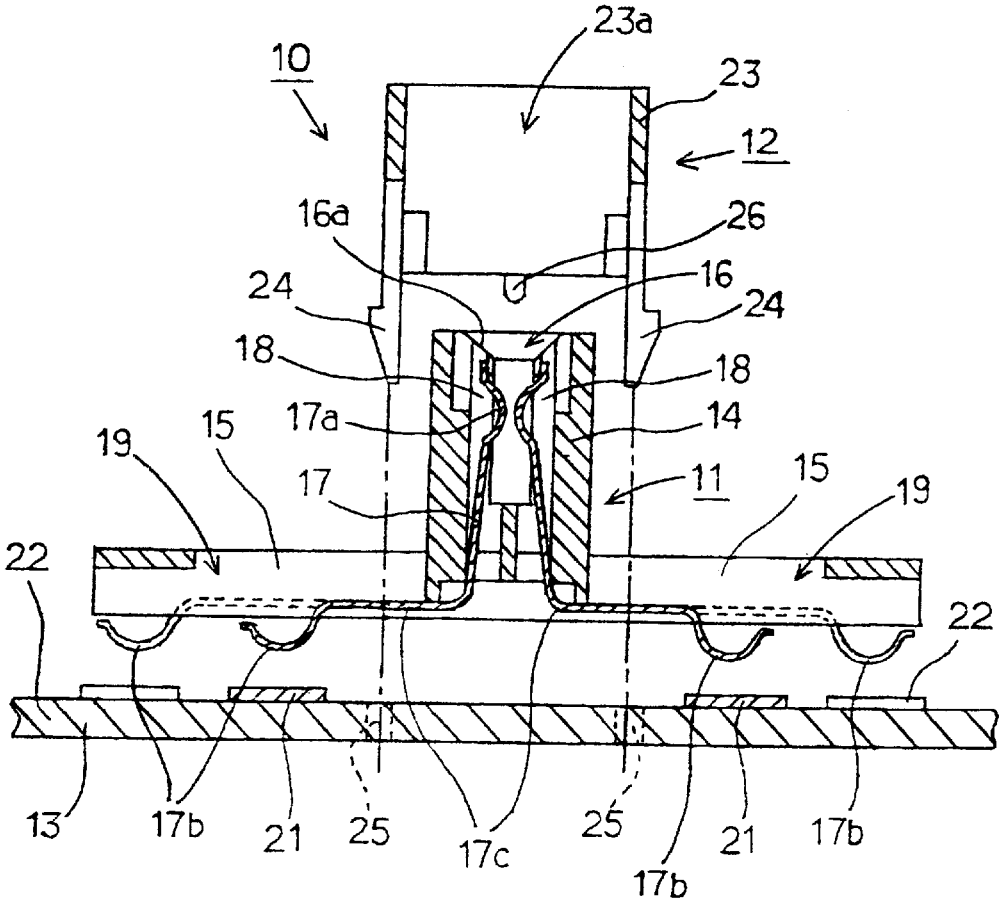
FIG. 1 is a sectional view of a floating connector according to a first embodiment of the present invention.
Figure 2:
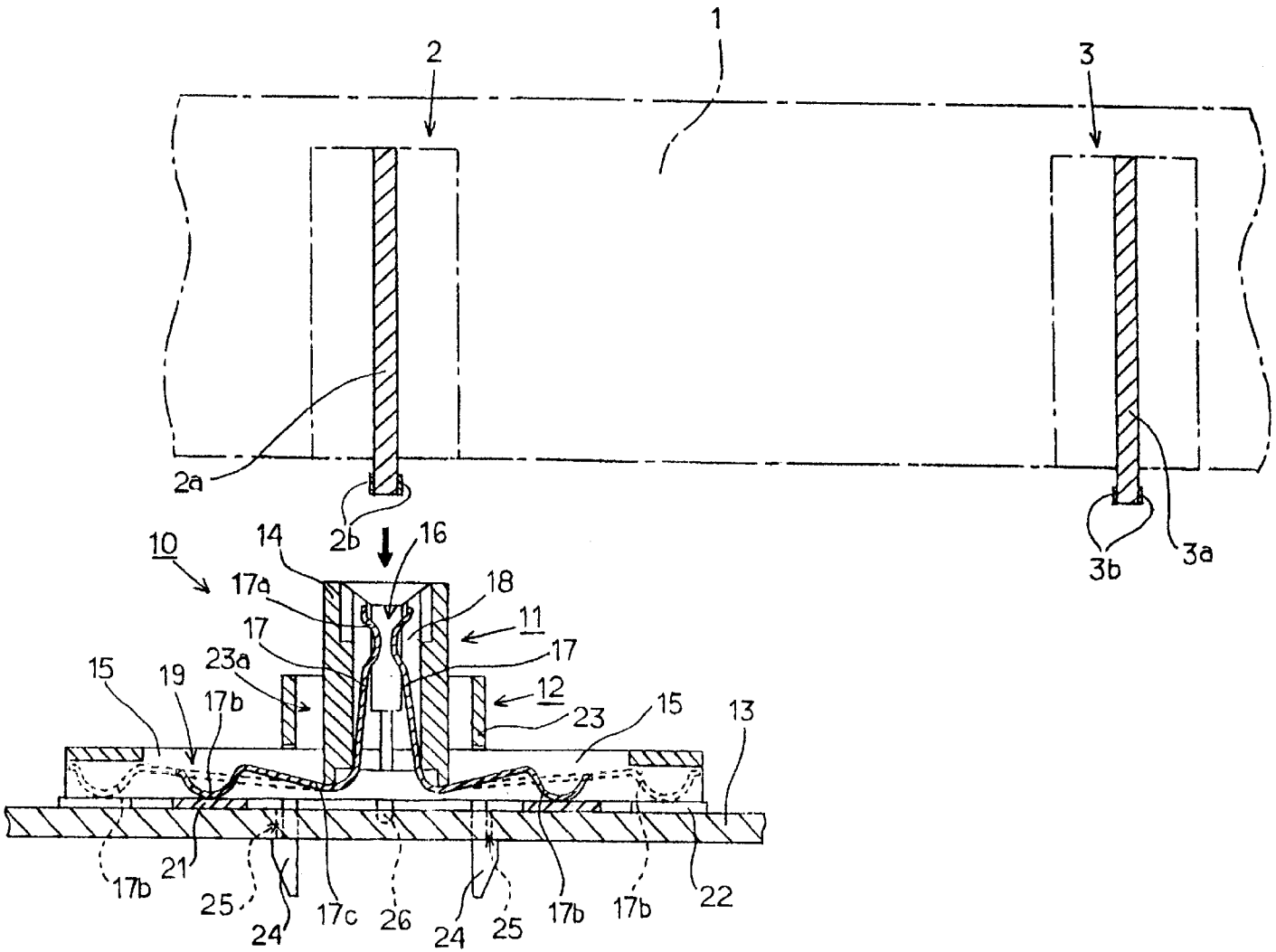
FIG. 2 is a sectional view of a floating connector connected to an external unit.
Figure 3:
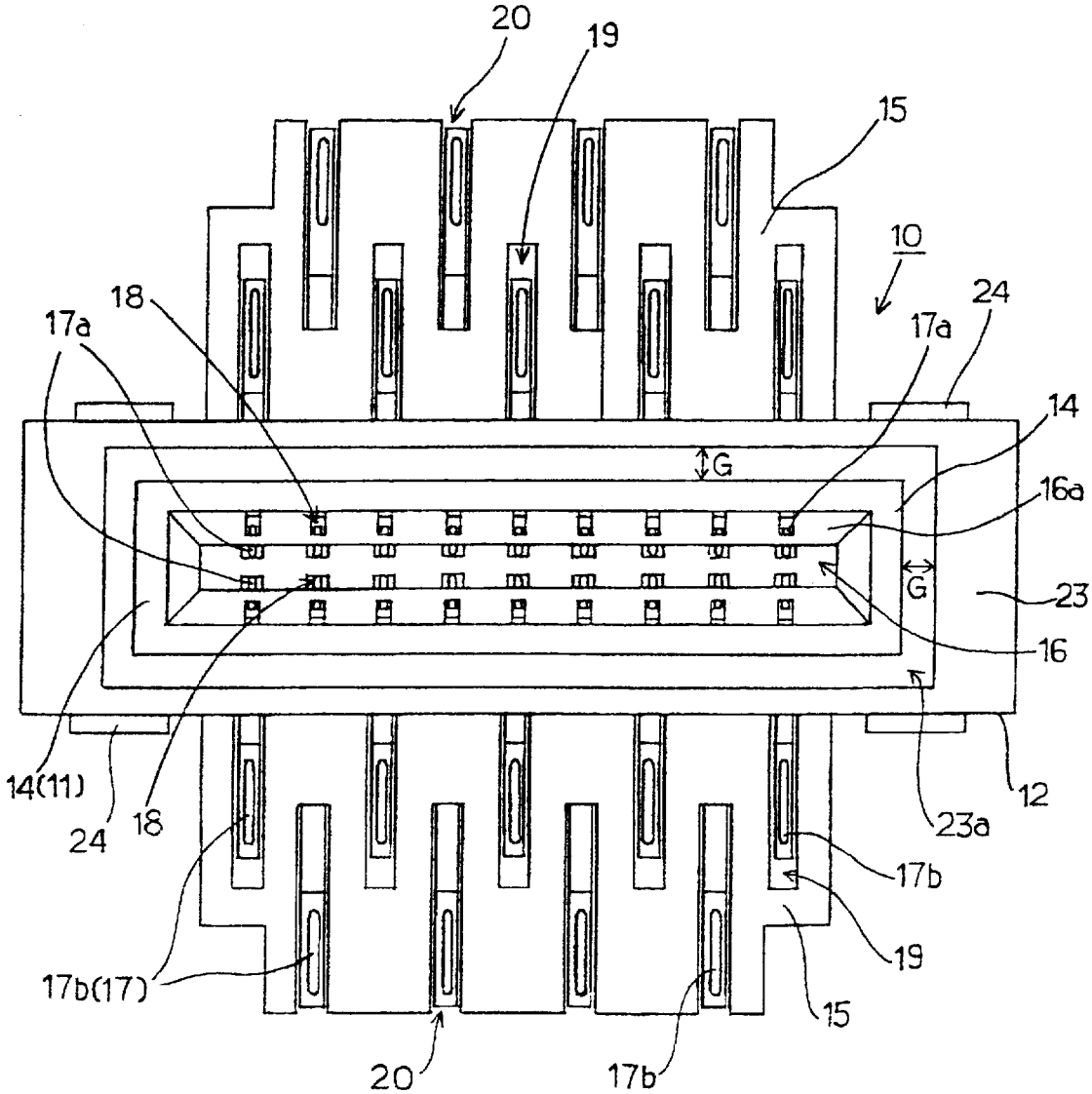
FIG. 3 is a plan view of a floating connector.

Referring to FIGS. 1 and 2, a floating connector 10, includes an insulated housing 11 and a cover 12. Floating connector 10 mounts on a printed circuit board 13. Printed circuit board 13 mounts switches (not shown) on a surface panel of an electronic equipment chassis 1. Electronic equipment chassis 1 includes a operable units 2 and 3 such as a CD unit, a MD (mini-disk) unit, DVD unit, or a tuner. It is to be understood that equipment chassis 1 may included multiple operable units 2, 3, or others, according to customer need.

Operable units 2, 3, include a sub-substrate 2*a*, 3*a*, that mounts various electronic components. Each sub-substrate 2*a*, 3*a*, has an external terminal 2*b*', 3*b*', on a first end extending away from corresponding unit 2, 3. External terminals 2*b*', 3*b*' are formed on opposite surfaces of the first end and constitute a conducive pattern electrically connectable to floating connector 10.

Insulated housing 11 includes a connecting portion 14. A supporting plate portion 15 is positioned generally orthogonal to said connection portion. Insulated housing 11 is typically molded from an insulating synthetic resin.

Connecting portion 14 extends upward(orthogonal) from a horizontal surface of a printed circuit board 13. This upward direction is to be understood as a vertical direction, as will be explained. It is to be understood, that the phrases upward, downward etc are used for convenience only in this description since the invention may be positioned in multiple directions according to user need.

Connecting portion 14 is externally shaped into a horizontally long rectangle and includes an insertion hole 16. Insertion hole 16 penetrates connecting portion 14 and is shaped as a long horizontal rectangle. A tapered guide surface 16*a* is formed on an upper end side of insertion hole 16 and facilitates the insertion of sib-substrates 2*a*, 3*a*, as will be explained.

A plurality of locking grooves 18 are on the inner wall surfaces of insertion hole 16 along the vertical direction. Locking grooves 18 engage and lock the positions of terminal portions 17*a* located on one side of each contact 17, as will be explained.

Locking grooves 18 are at equal pitches along longitudinal inner side surfaces of connecting portion 14, so that terminal portions 17*a*, may attache in two rows opposite to one another across insertion hole 16, as will be explained.

Figure 4:
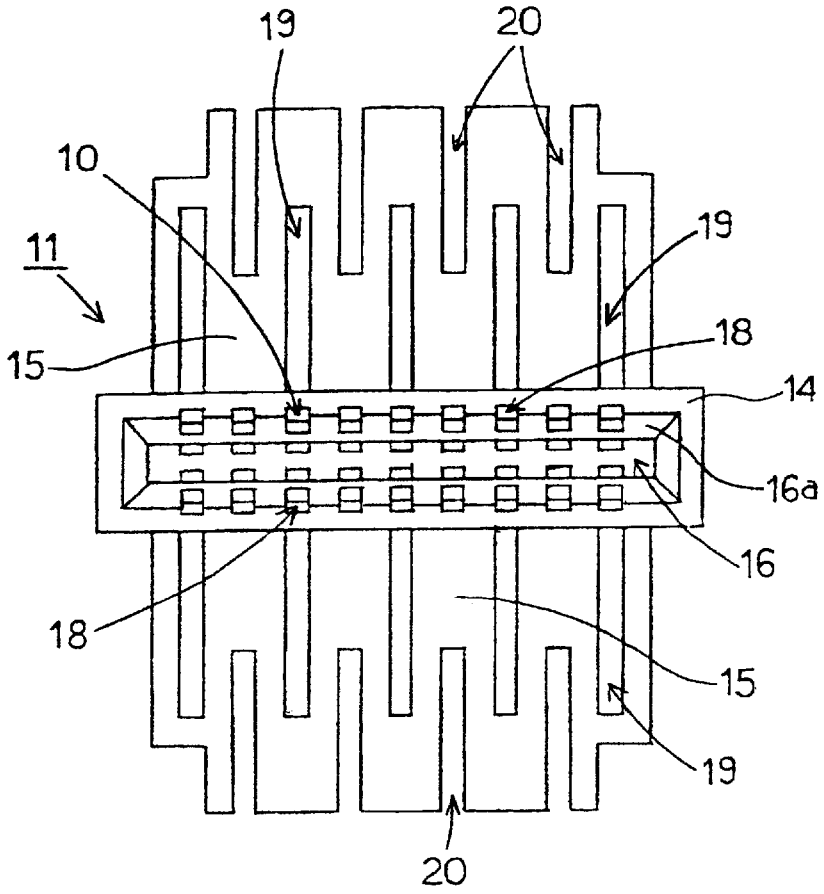
FIG. 4 is a plan view of an insulated housing.
Figure 5:
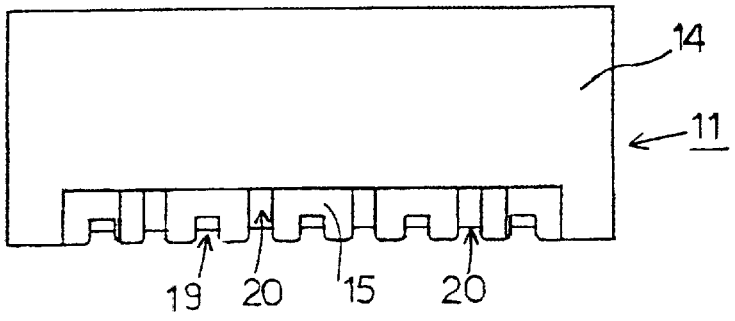
FIG. 5 is a front view of the insulated housing.

Additionally referring now to FIGS. 4 through 5, supporting plate portions 15, 15 are separate from connecting portion 14. Supporting plate portions 15, 15 extend from a bottom of connecting portion 14 on opposite sides in a horizontal direction. Supporting plate portions 15, 15 each have staggered slits 19, 20 along two or more rows. Stagger slits 19, 20 accommodate lead-out portions 17*b* located on the other side of contacts 17.

Slits 19,20 are on a connecting portion 14 side of supporting plate portions 15. Slits 20 are formed on a side of supporting plate portion 15 remote from connecting portion 14. Thus, slits 19, 20 prevent electrical contact between adjacent contacts 17 or land patterns 21, 22, as will be explained.

Contacts 17 are attached to insulated housing 11 and molded in an approximate L-shape. In assembly, terminal portions 17*a* are inserted in connecting portion 14 from below and pressed into and locked in locking groove 18. Contacts 17 are attached to insulated housing 11 and aligned on equal pitches to one another. Terminal portions 17*a* face insertion hole 16 to contact conductive patterns 2*b*', 3*b*'.

Contacts 17 have a base 17*c* bent perpendicularly below connecting portion 14, along the direction of supporting plate portion 15. Lead-out portions 17*b* are guided by slits 19, 20 to allow elastic expansion outward along a bottom surface of supporting plate portion 15.

A first and a second length lead-out portions 17*b*, 17*b* are required for contacts 17, 17. Slits 19, 20 are staggered in two alternating rows to accommodate first and second lead-out portions 17*b*, 17*b*.

Figure 6:
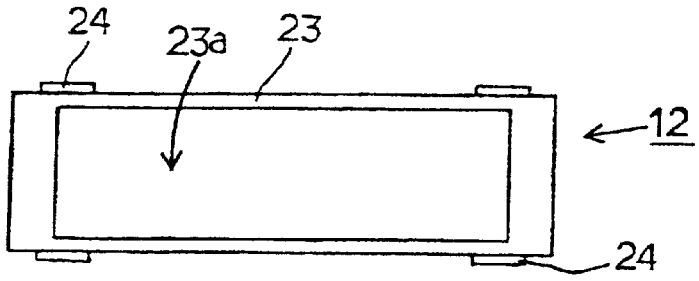
FIG. 6 is a plan view of a cover.
Figure 7:
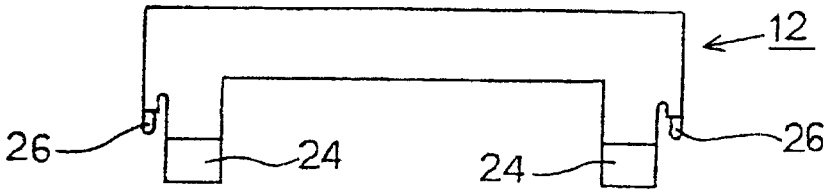
FIG. 7 is a front view of the cover.
Figure 8:
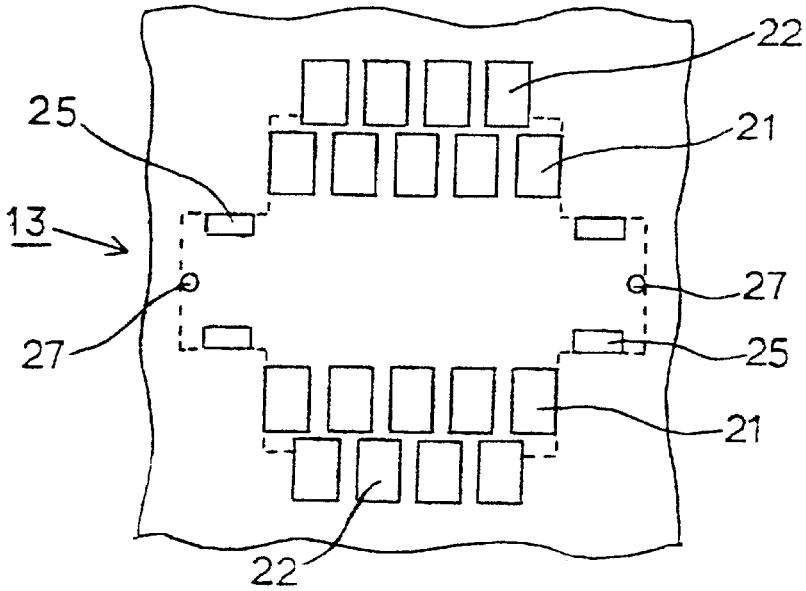
FIG. 8 is a partial plan view of a printed circuit board.

Additionally referring now to FIGS. 6 through 8, lead-out portions 17*b*, 17*b* correspond to a plurality of staggered land patterns 21,22 on printed circuit board 13. As a result, lead-out portions 17*b*, 17*b*, allow elastic contact with corresponding land patterns 21, 22. A curved end portion of lead-out portions 17*b*, allows sliding contact on land patterns 21, 22 without solder, as will also be explained.

A cover 12 includes a presser portion 23 and a hook portion 24. Presser portion 23 is externally shaped into a rectangular cylinder. Hook portion 24 is integrally formed with a lower end of presser portion 23.

Presser portion 23 has an insertion hole 23*a* lager than the external shape of connecting portion 14. Insertion hole 23*a* is also shaped in a horizontally long rectangle similar to the external shape of connecting portion 14. Insertion hole 23*a* allows loose insertion of connecting portion 14 of insulated housing 11. A fixed gap G forms between presser portion 23 and connection portion 14 after insertion.

Gap G is substantially uniform about the outer circumference of connecting portion 14. Gap G allows insulated housing 11 to move a distance corresponding to gap G, in the transverse (longitudinal or lateral) direction of circuit board 13, thus allow for adjustment and misalignment.

Presser portion 23 of cover 12 has integrally formed hook portions 24. Hook portions 24 are at the four bottom corners of presser portion 23. Hook portions 24 include retaining edges to affix to printed circuit board 13, as will be explained. Engagement holes 25, in printed circuit board 13 are positioned to receive hook portions 24. Hook portions 24 lock and fix cover 12 to printed circuit board 13, as will be explained.

Upon assembly, a lower end surface of pressure portion 23 abuts a surface side of supporting plate portions 15, 15. The lower end surface of pressure portion 23 serves to sandwich supporting plate portions 15, 15 between presser portion 23 and printed circuit board 13 to secure an electrical connection. Thus, connecting portion 14 is allowed compensating movement and supporting plate portions 15, 15 are frictionally secured to printed circuit board 13. As a result, supporting plate portions 15, 15 may be frictionally adjusted where needed by an end user.

The presser cylindrical portion 23 has hook portions 24 formed integrally therewith at the bottom of four corners thereof in such a fashion as to extend perpendicularly. The hook portions 24 penetrate through engagement holes 25 formed in the printed circuit board 13 to engage with the printed circuit board 13, thereby fixing the cover 12 to the printed circuit board 13 in a locked but adjustable state.

Positioning projections 26 are formed on longitudinally opposite ends of cover 12. Positioning projections 26 extend away from cover 12. Positioning holes 27 are formed in printed circuit board 13, below cover 12. Positioning holes 27 are shaped to receive positioning projections 26 and act to position cover 12 on printed circuit board 13. Together, positioning holes 27 and positioning projections 26 act to minimize elastic backlash when fixed cover 12 to printed circuit board 13.

Land patterns 21, 22 are formed on a top surface(also called the front surface) of printed circuit board 13 opposite cover 12. After assembly, land patterns 21, 22 electrically connect to contacts 17 and allow electrical control of units 2, 3, 4, or other devices through lead patterns(not shown) on printed circuit board 13.

Land patterns 21, 22 are staggered on printed circuit board 13 and positioned to maintain electrical contact with the variable lengths of lead-out portions 17*b*. Land patterns 21, 22 allow electrical connection with contacts 17 through the range of motion allowable by gap G. The curved end portion of lead-out portions 17*b* allows sliding electrical contact with land patterns 21, 22.

Land patterns 21,22 are each formed to embrace an elastic contact area of lead-out portions 17*b*, and have vertical and horizontal widths at least equal to or greater than the length of gap 2G.

It is to be understood, that insulated housing 11 and each contact 17 can be moved a distance corresponding to the length of gap 2G within a fixed area in the longitudinal or lateral direction in parallel with printed circuit board 13.

In this embodiment, since the lengths of the lead-out portions 17*b* of the adjacent contacts 17 vary, the land patterns 21, 22 are staggered to allow the corresponding lead-out portions 17*b* to contact therewith.

It is to be understood, that floating connector 10, according to the first embodiment is assembled by covering insulated housing 11 and contacts 17 with cover 12 so that connecting portion 14 loosely fits within presser portion 23.

In detail, insulated housing 11 is first placed on printed circuit board 13 to position lead-out portions 17*b* opposite to and on land patterns 12, 22. Second, cover 12, with presser portion 23 is placed over insulated housing 11 and hook portions 24 are inserted into engagement holes 25 to engagingly lock cover 12. Third, positioning projections 26 are fitted in positioning holes 27 so that cover 12 is further accurately positioned on printed circuit board 13.

Once cover 12 is fixed, supporting plate portions 15, 15 are next sandwiched between the lower end surfaces of presser portions 23 to frictionally lock insulated housing 11 within the fixed lateral or longitudinal range described above.

Alternatively, cover 12 with insulated housing 11, may be fixed to printed circuit board 13 after connecting portion 14 is inserted into presser portion 23.

After installation, lead-out portions 17*b* of contacts 17 project through slits 19, 20 and contact opposing land patterns 21, 22 and establish slidable elastic electrical contact.

After, floating connector 10 is installed on printed circuit board 13, sub-substrates 2*a*, 3*a*, of equipment chassis 1, are inserted at connecting portion 23 into insertion hole 16, terminal portions 17*a* electrically contact external terminals 2*a*', 3*a*'. In this manner, printed circuit board 13 is electrically connected to chassis 1.

It is to be understood, that during installation, floating connector 10 can be independently adjusted along the transverse surface direction of printed circuit board 13. In this manner, connecting cylindrical portion 23 follows the position of sub-substrates 2*a*, 3*a* in the lateral or longitudinal direction or a mixture of both.

It is to be further understood, that since lead-out portions 17*b* of each contact 17 are elastically deformed during installation, insulated housing 11 may be adjusted orthogonally(vertically) to the surface of printed circuit board 13 as allowed by the elastic deformation of contacts 17. As a result, connecting portion 14 may extend away from circuit board 13 while maintaining electrical connection through elastic contacts 17. It is also to be understood that insulated housing 11 may be allowed to move at an angle (inclined) to the vertical surface of printed circuit board 13 through a combination of transverse and orthogonal adjustment, to ensure electrical connection.

It is to be further understood, that since the above described embodiment allows adjustment in the vertical, horizontal, and longitudinal directions relative to circuit board 13 or units 2, 3, electrical connections may be maintained despite misalignment, and assembly errors minimized.

It is to be further understood, that since lead-out portions 17*b* and terminal portions 17*a* of contacts 17 are in slidable elastic contact with respective land patterns 21, 22 and external terminals 2*b*', 3*b*' the soldering step is eliminated. The elimination of a soldering step both reduces assembly time and minimizes environmental concerns. The elimination of a soldering step also minimizes cracks and pattern 'peel-off' thereby increasing reliability.

It is to be further understood, that since terminal portions 17*a* are arranged in connecting portion 14 at equal pitches and lead-out portions 17*b* project outward from cover 12, a well-balanced contact is maintained and reliability is increased.

Figure 9:
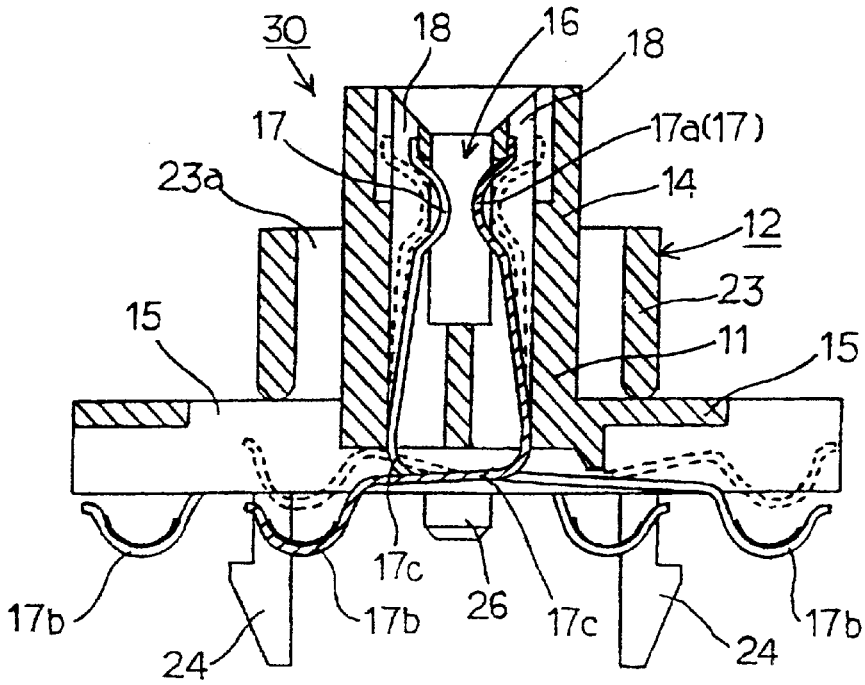
FIG. 9 is a vertical sectional view of a floating connector according to a second embodiment of the present invention.
Figure 10:
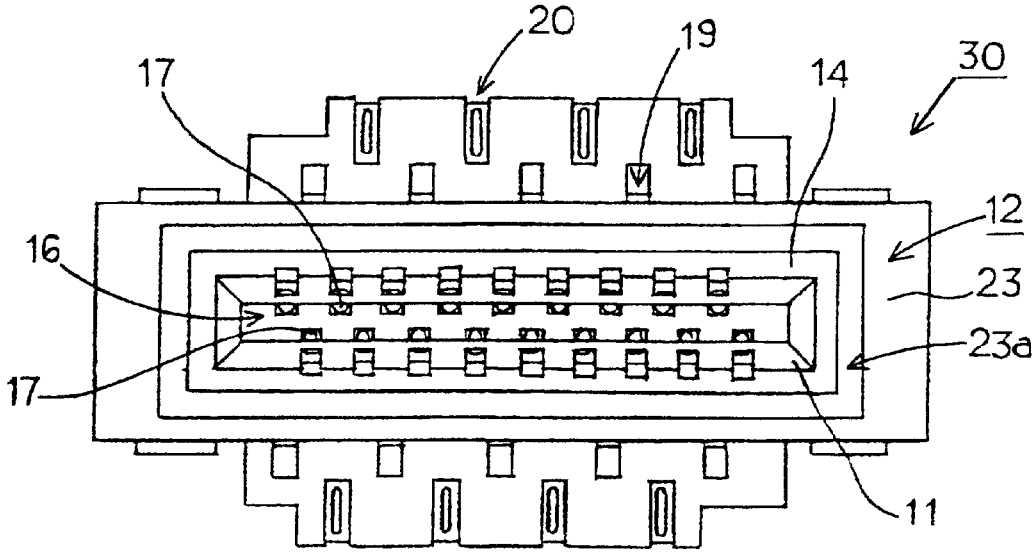
FIG. 10 is a plan view of the floating connector.

Additionally referring now to FIGS. 9 and 10, showing a floating connector 30 of a second embodiment of the present invention. In this embodiment, bases 17*c* of contacts 17 are positioned opposite each other inside insulated housing 11. Bases 17*c* do not electrically contact one another since contacts 17, 17 are arranged opposite each other inside insertion hole 16 and hang from terminal portions 17*a*.

Terminal portions 17*a* are inserted in and retained by locking grooves 18. Locking grooves 18 are formed along an inner surface of connection portion 14. Contacts 17 hang from locking grooves 18 and bases 17*c* are elastically bent to come into elastic electrical contact with land patterns 21, 22 on printed circuit board 13. As, in the first embodiment, a free end side of lead-out portions 17*b* elastically contacts land patterns 21, 22 to ensure electrical contact.

In the second embodiment, since bases 17*c* are arranged to cross each other a spring-span of each lead-out portion 17*b* is supported in a cantilever manner and is increased beyond that of the first embodiment. As a result, plastic (not elastic) deformation of lead-out portions 17*b* is minimized. Since plastic deformation of lead-out portions 17*b* is minimized durability and life span is increased.

Additionally, it is to be understood, that since bases 17*c* cross each other, their respective projecting length from connecting cylindrical portion 14 is minimized. Since the projecting length is minimized, supporting plate portions 15 may be reduced and shortened. Since supporting plate portions 15 are reduced, insulated housing 11 may also be reduced in size thereby reducing the overall size of floating connector 30.

It is to be understood, that despite a reduction in the size of floating connector 30, the adjustable nature of floating connector 30 is maintained or increased.

Figure 11:
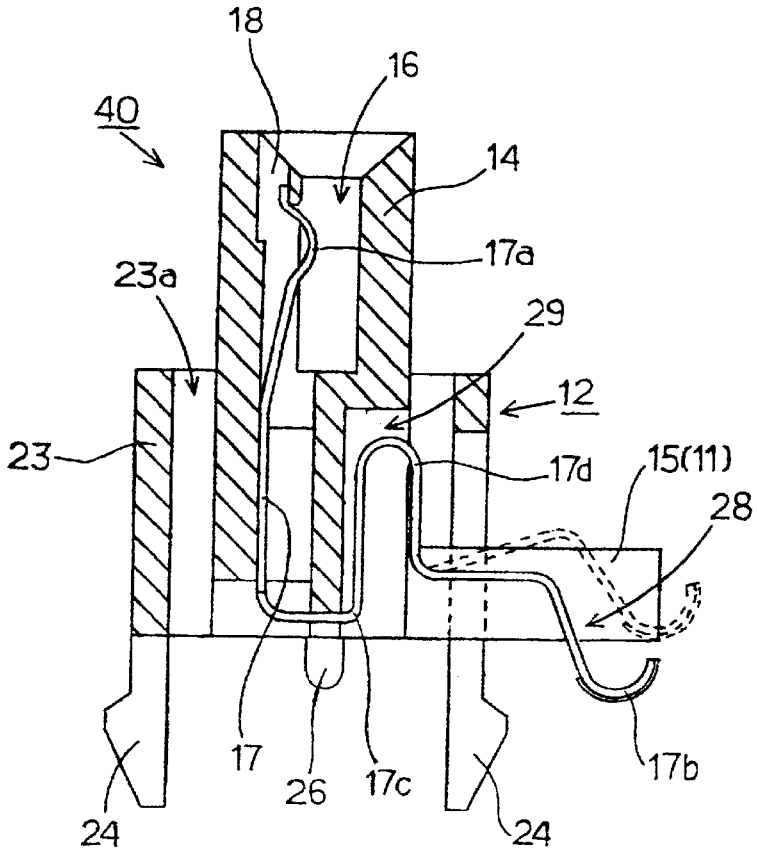
FIG. 11 is a sectional view of a floating connector according to a third embodiment of the present invention.
Figure 12:
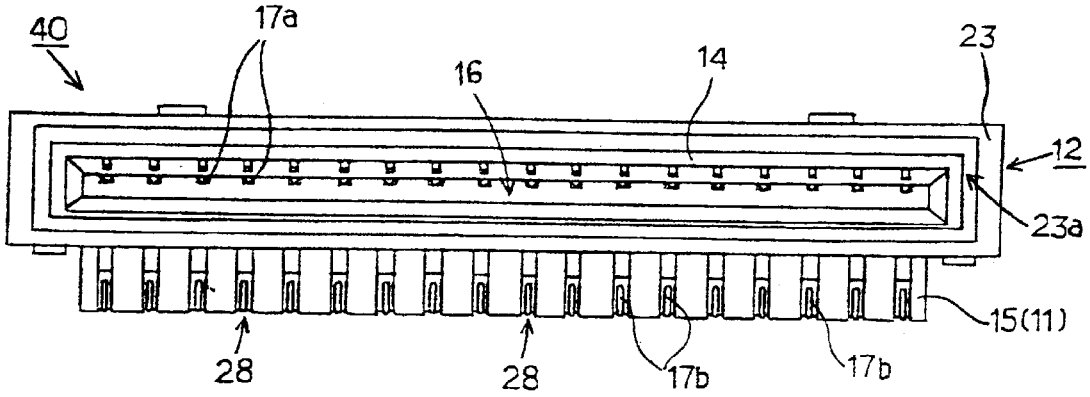
FIG. 12 is a plan view of the floating connector.
Figure 13:
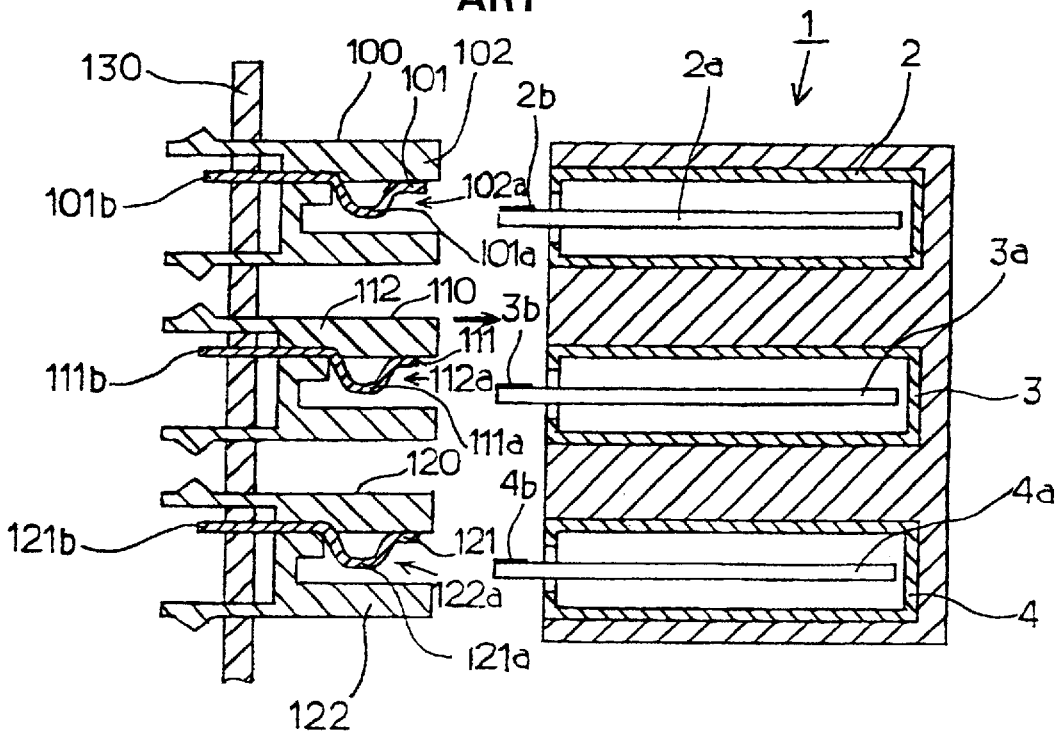
Fig. 13 PRIOR ART
FIG. 13 is a sectional view of a plurality of conventional units connected to an equipment chassis.
Figure 14:
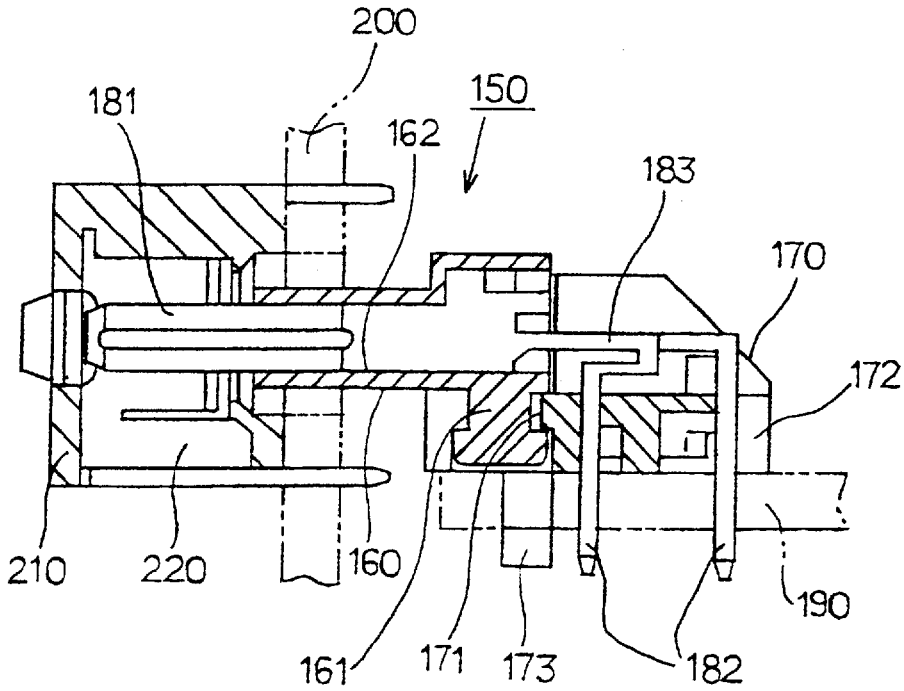
Fig. 14 PRIOR ART
FIG. 14 is a sectional view of a conventional floating connector.
Figure 15:
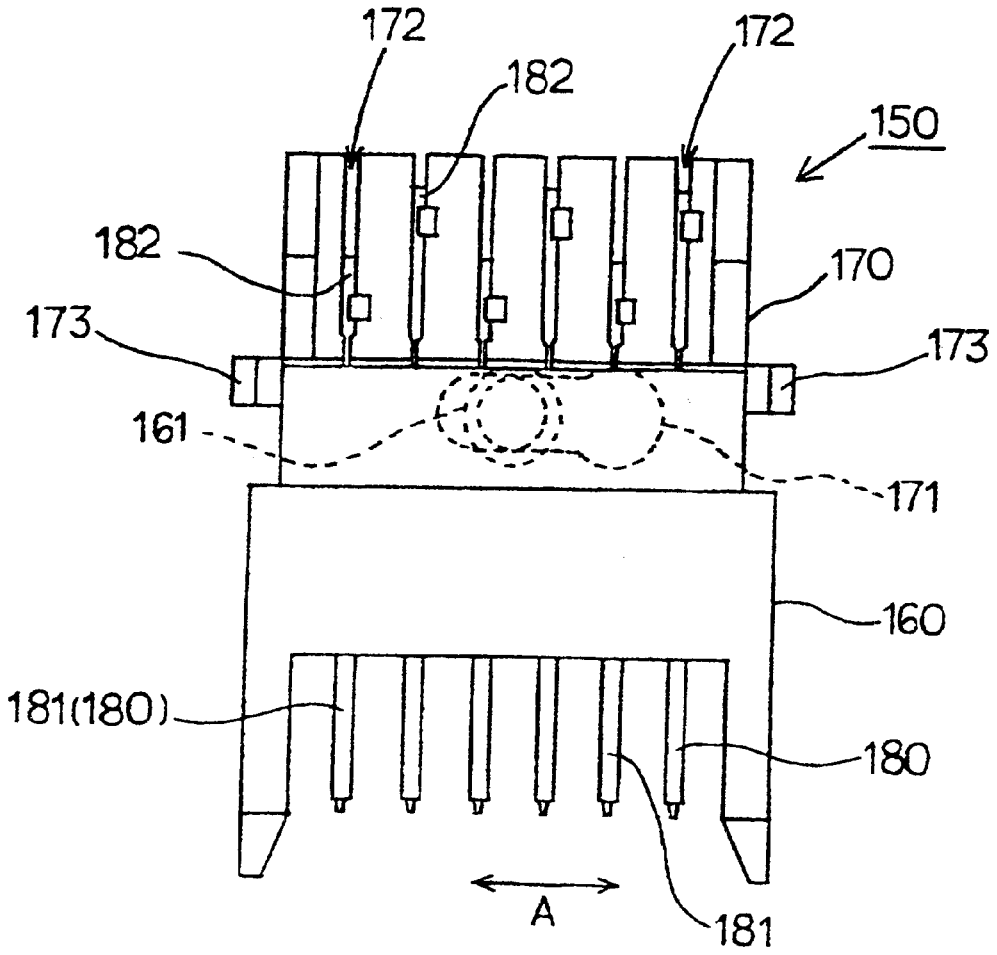
FIG. 15 is a plan view of a conventional floating connector.

Additionally referring now to FIGS. 11 and 12, showing a floating connector 40 of a third embodiment of the present invention. In the third embodiment, supporting plate portion 15 of insulated housing 11 is on a single first side along connection portion 14.

Slits 28 are formed in supporting plate portion 15 in a series of single lines. Lead-out portions 17*b* of contacts 17 fit into slits 28 and allow electrical connection with corresponding land patterns 21, 22 on printed circuit board 13.

A plurality of recessed vertical slits 29 are externally formed on the first side of connecting portion 14. Vertical slits 29 are on the same first side as supporting plate portion 15. Each vertical slit 28 corresponds to one of slits 28. Vertical slits 29 communicate with the inside of each corresponding slit 28.

A buffer portion 17*d* of contact 17 is recessed slit 29. Buffer portion 17*d* is bent to stand away from base 17*c* of contact 17 and away from printed circuit board 13.

During assembly, terminal portion 17*a* is inserted and engagingly locks into locking groove 18. Terminal portion 17*a*, hangs along an inner surface of connecting portion 14 and is elastically retained within connecting portion 14. Buffer portion 17*d* inserts into recessed slit 29 and lead-out portion 17*b* inserts into slit 28 in supporting plate portion 15.

It is to be understood, that buffer portion 17*d* serves to increase the spring span of contact 17 while additionally serving to prevent plastic(not elastic) deformation. It is to be further understood, that since supporting plate portion 15 is on only the first side of connecting portion 14, the overall size of floating connector 40 may be reduced. It is to be further understood, that in the same embodiment, supporting plate portion 15 with slits 28, and contacts 17 with buffer portions 17*d*, may be provided on both sides of connecting portion 14 according to manufacturer need while still maintaining a minimum shape.

It is to be further understood, that in a fourth combination (not shown) according to the instant invention, cover 12, may be made of metal or other strong conductive material. Cover 12 may be made of metal or other strong conductive material to increase strength and minimize static electricity while actively shielding contacts 17 from electromagnetic waves.

It is to be further understood, that in the fourth combination, at least one grounding pattern(not shown) is on printed circuit board 13 where cover 12 inserts.

It is to be understood that the grounding pattern may be formed on the top or bottom surface of printed circuit board 13 and engage alternatively hook portions 24, or positioning projections 26, or both according to manufacturer need. Depending upon further manufacturer need, hook portions 24 and positioning projections 26 may release-ably and slidably engage the ground patterns or may be soldered to the ground patterns.

It is to be understood, that in the above embodiments, floating connectors 10, 30, and 40 connect to substrates 2*a*, 3*a*, and may be connected to additional substrates(not shown) according to manufacturer need.

It is to be understood that external terminals 2*b*', 3*b*' are not limited to the conductive patterns on circuit board 13, but may be connectors or contacts attached to plugs, or conductive patters such as an IC card or a memory card in alternative embodiments.

It is to be further understood, that insulative housing 11, cover 12, and support plates 15 may be adapted to rectangular, square, semicircular, triangular, or other simple or complex geometric shape according to manufacturer desire to reduce or increase the size of the floating connector or increase contact connections through a single floating connector.

It is to be further understood, that hook portions 24 may be extended a set distance(not shown) below circuit board 13 to allow orthogonal adjustment of insulating housing away from circuit board 13. In this embodiment, hook portions 24 are slidably through engagement holes 25 away from circuit board 13. As a result, electrical connection is maintained alternatively through elastic lead-out portions 17*c*, base 17*c*, and buffer portions 17*d* depending upon the embodiment required by the manufacturer.

It is to be further understood, that although the above embodiments may describe only a first or a first and second row on only a first or a first and second supporting plate portion that these may be arranged according to manufacturer need. It is to be further understood, that any of these combinations may be combined to include buffer portions 17*d* and vertical slits 29.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A floating connector for use with a circuit board having a plurality of contact pads thereon, comprising;

a support plate a plurality of resilient contacts on a surface of said support plate which faces said circuit board;

at least some of said resilient contacts being alienable with ones of said contact pads;

a connection portion rising orthogonal to said support plate;

said connection portion including means for positioning terminal portions connected to said resilient contacts;

said means for positioning being effective for positioning said terminal portions accessible to an external plug;

a cover fittable over said connection portion;

an opening in said cover;

said opening having an internal dimension larger than an external dimension of said connection portion, whereby a gap remains between said cover and said connection portion;

said gap permitting said connection portion to adjust transversely to accommodate misalignment of said external plug; and means for latching said cover into frictional contact with said support plate whereby said resilient contacts are urged into contact with said contact pads without solder.

2. A floating connector, according to claim 1, wherein:

said means for positioning permitting said connection portion to adjust orthogonally to said circuit board to accommodate misalignment of said external plug.

3. A floating connector, according to claim 2, further comprising:

a presser portion in said cover; and said presser portion in frictional contact with said support plate thereby permitting said support plate to move transversely to accommodate misalignment of said external plug.

4. A floating connector, according to claim 2, further comprising;

an insert hole;

said insert hole extends from a top side to a bottom side of said connection portion;

a tapered guide surface on said top side of said insert hole; and said tapered guide surface permitting easy insertion of said external plug.

5. A floating connector, according to claim 4, further comprising:

a plurality of locking grooves on a first and second inner wall surface of said insert hole;

said locking grooves being effective to electrically separate said terminal portions; and said locking grooves being effective to lock said terminal portions in said connection portion whereby said terminal portions are accessible to said external plug.

6. A floating connector, according to claim 5, further comprising a plurality of slits on said support plate;

said slits in at least a first row;

said slits extending from said bottom side to a top side of said at least first support plate;

each said slit being effective to receive and guide each said contact during adjustment; and said slits being effective to electrically separate said contacts during adjustment.

7. A floating connector according to claim 6, further comprising:

at least said first and a second support plate;

said connection portion rising orthogonal to said second support plate;

said second support plate opposite said first support plate;

said slits in at least said first row on said second support plate;

a first section of said terminal portions on said first inner wall surface;

a second section of said terminal portions in said second inner wall surface;

said first section connected to said resilient contacts on said first support plate; and said second section connected to said resilient contacts on said second support plate.

8. A floating connector according to claim 7, further comprising:

said slits in said first and a second row;

said first and second rows on each said first and second support plate;

said second rows being further from said connecting portion than said first rows;

said resilient contacts having one of at least a first and a second length;

said second length greater than said first length;

said slits in said first rows operably receiving said resilient contacts having said first lengths;

said slits in said second rows operably receiving said resilient contacts having said second lengths; and said slits in said first rows alternating with said slits in said second rows to operably insulate and guide said contacts and permit elastic slidable electrical connection with said external circuit board without solder.

9. A floating connector according to claim 8, wherein:

said cover is constructed from at least a first material;

said first material being a metal; and said metal being effective to strengthen said cover whereby cover failure is minimized.

10. A floating connector according to claim 9, wherein:

said cover is electrically grounded to said circuit board through an external ground pattern, whereby said cover is effective to shield said connection portion and said resilient contacts from electromagnetic waves and static disruption.

11. A floating connector according to claim 6, further comprising:

at least said first and a second support plate;

said connection portion rising orthogonal to said second support plate;

said second support plate opposite said first support plate;

said slits in at least said first row on said second support plate;

a first section of said terminal portions on said first inner wall surface;

a second section of said terminal portions in said second inner wall surface;

said first section connected to said resilient contacts on said second support plate;

said second section connected to said resilient contacts on said first support plate; and said resilient contacts operably extending across said insert hole and being operably effective to increase elastic deformation of said resilient contacts without solder.

12. A floating connector according to claim 11, further comprising:

said slits in said first and a second row;

said first and second rows on each said first and second support plate;

said second rows being further from said connecting portion than said first rows;

said resilient contacts having one of at least a first and a second length;

said second length greater than said first length;

said slits in said first rows operably receiving said resilient contacts having said first lengths;

said slits in said second rows operably receiving said resilient contacts having said second lengths; and said slits in said first rows alternating with said slits in said second rows to operably insulate and guide said contacts and permit elastic slidable electrical connection with said external circuit board without solder.

13. A floating connector according to claim 12, wherein:

said cover is constructed from at least a first material;

said first material being a metal; and said metal being effective to strengthen said cover whereby cover failure is minimized.

14. A floating connector according to claim 13, wherein:

said cover is electrically grounded to said circuit board through an external ground pattern, whereby said cover is effective to shield said connection portion and said resilient contacts from electromagnetic waves and static disruption.

15. A floating connector according to claim 6, further comprising:

a plurality of vertical recessed slits;

said recessed slits on at least one side of a first and second side of said connecting portion;

said recessed slits operably extending from said at least one side to each corresponding said slit;

said recessed slits opposite said locking grooves on at least one said first and second inner wall;

a buffer portion on each said resilient contact;

said buffer portions operable within said recessed slits;

said buffer portions being effective to increase a spring span of each said resilient contact whereby elastic fatigue is reduced; and said vertical recessed slits being effective to electrically insulate each said buffer portion and said resilient contact during said adjustment along said circuit board without solder.

16. A floating connector, according to claim 15, further comprising:

at least said first and a second support plate;

said connection portion rising orthogonal to said second support plate;

said second support plate opposite said first support plate;

said slits in said first row on said second support plate;

said locking grooves on said first and said second inner wall surfaces;

said terminal portions on said first inner wall surface extending under said second support plate;

said terminal portions on said second inner wall surface extending under said first support plate;

said resilient contacts flexibly extending across said insert hole; and said buffer portions flexibly extending across said insert hole and being effective to increase elastic deformation of said contacts whereby elastic fatigue of said resilient contacts is reduced.

* * * * *